US008416135B2

(12) United States Patent
Ni

(10) Patent No.: US 8,416,135 B2
(45) Date of Patent: Apr. 9, 2013

(54) PLANE ANTENNA

(75) Inventor: Chin Wei Ni, Taipei (TW)

(73) Assignee: Sercomm Corporation, Taipei (TW)

( * ) Notice: Subject to any disclaimer, the term of this patent is extended or adjusted under 35 U.S.C. 154(b) by 690 days.

(21) Appl. No.: 12/360,632

(22) Filed: Jan. 27, 2009

(65) Prior Publication Data

US 2010/0188293 A1 Jul. 29, 2010

(51) Int. Cl.
*H01Q 1/38* (2006.01)

(52) U.S. Cl.
USPC ..... 343/700 MS

(58) Field of Classification Search ..... 343/700 MS
See application file for complete search history.

(56) References Cited

U.S. PATENT DOCUMENTS

| | | | | |
|---|---|---|---|---|
| 7,463,199 | B2 * | 12/2008 | Soler Castany et al. | 343/700 MS |
| 2006/0256018 | A1 * | 11/2006 | Soler Castany et al. | 343/700 MS |
| 2008/0084352 | A1 * | 4/2008 | Piskun | 343/700 MS |

* cited by examiner

*Primary Examiner* — Robert Karacsony
(74) *Attorney, Agent, or Firm* — WPAT PC; Justin King

(57) ABSTRACT

A wireless internet with a plane antenna, the plane antenna comprises a plane, an import and an export antenna and plural radiators. The import antenna has a first and a second import line which connect with each other and an included angle is formed between the second and the first import line, the export antenna has a first and a second export line which connect with each other and the included angle is formed between the second and the first export line. The radiators are disposed between the import and the export antenna, each radiator having a first and a second conducting wire, a sharp part, a first and a second protruding fringe and a fillister. The radiators are divided into two symmetrically arranged teams. The connected angles between two neighboring radiators in the one of the teams are different.

4 Claims, 6 Drawing Sheets

PLANE ANTENNA

FIELD OF THE INVENTION

The present invention relates to a plane antenna, particularly, a wireless Internet apparatus with the plane antenna.

BACKGROUND OF THE INVENTION

Referring to FIG. 1 is a solid schematic view of a topic wireless Internet apparatus 10 with a plane antenna. The wireless internet apparatus is provided for a substance 11, an interior electric circuit apparatus of the substance interior 12, a point of the connector part 13 connects with a exterior host (non-shown) and the substance 11 is compared to another a antenna signal receive part 14. Generally, the antenna signal received part 14 of a case is composed of the non-metal material and the wireless Internet apparatus 10 connects with the exterior host. The antenna signal received part 14 needs to expose the exterior part of the exterior host for receiving wireless signal effectively.

Referring to FIG. 1, the dead corner of the plane of the radiation pattern of the wireless internet apparatus 10 on the X-Y plane is large. For example, FIG. 2 shows the radiation pattern of X-Y plane analyses of wireless internet apparatus 10 in FIG. 1. In the radiation pattern of FIG. 2, the average gain value is only −4.3 dBi of the wireless internet apparatus 10. Another, the FIG. 3 shows analyses the loss of the wireless internet apparatus 10 in a round trip pattern. The loss of a round trip pattern of the FIG. 3, a frequency range from 2.4 GHz. to about 2.5 GHz, the loss in the round trip of the wireless internet apparatus 10 is about −12.6 dB The value is much higher than a frequency antenna design of a round trip of the general market which is lower than −10 dB request. Obviously, there are further step for the improvement.

Therefore, the antenna designs of the wireless internet apparatus 10 are developed. In the embodiments described below, we raise the isolation between each antenna on X-Y plane and reduce the dead corner at the radiation pattern for improving the X-Y plane receiving capability.

SUMMARY OF THE INVENTION

The primary objective of the present invention is to provide a plane antenna; the efficiency of the plane antenna has been improved and the dead corner at the radiation pattern has been reduced to avoid the interference and to raise the antenna efficacy.

The above-mentioned, a preferred embodiment of a wireless Internet apparatus with the plane antenna in accordance with the present invention is included: a plane, an import line, a plurality of radiators and an exterior line. The plane has an edge; the import antenna is located on the plane, the import antenna has a first import line and a second import line, a point of the first import antenna connects with the edge, the second import line and the first import line connect with each other to have an included angle; the plurality of radiators has a preview arrangement method to connect with the plane, each radiator has a first conducting wire, a sharp part, a first protruding fringe, a fillister, a second protruding fringe and a second conducting wire; the export antenna is located on the plane, the export antenna has a first export antenna and a second export antenna, the second export line and the first export line connect with each other to have the included angle. Wherein the second import line and the second export line connect with different first conducting wires of the radiator.

To make it easier for our examiner to understand the objective of the invention, its structure, innovative features, and performance, we use preferred embodiments together with the attached drawings for the detailed description of the invention.

DETAILED DESCRIPTION OF THE PREFERRED EMBODIMENTS

In the related figures of a preferred embodiment, the same referring numerals are used for the same components of an input apparatus in accordance with the present invention.

Figure 4:
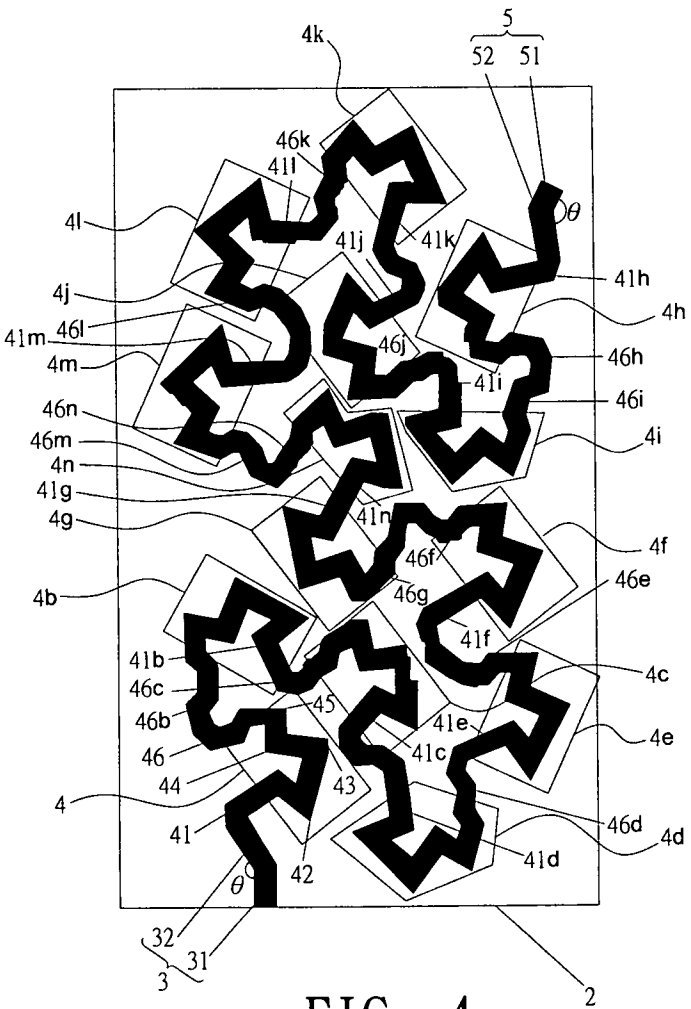
FIG. 4 is a schematic view of the plane antenna in accordance with preferred embodiment.

Referring to FIG. 4 for a schematic view of a plane antenna provided for processing a wireless internet apertures in accordance with the present invention, the plane antenna is composed of a substance 2, a import antenna 3, a plurality of radiators 4~41 and a exterior antenna 5. The substance 2 is composed of the dielectric material and the flat configuration. The substance 2 has a numbers of the electric circuit of the surface of the circuit element. (Upon surface) and the numbers of the weld tin of the side surface of weld tin (under surface).

An included angle θ is formed between the second import line 32 and the first import line 31. The export antenna 5 locates on the substance 2; the import antenna 5 has a first export line 51 and a second export line 52. The included angle θ is formed between the second export line 52 and the first export line 51.

Each radiator 4 includes a first conductive wire 41, a sharp part 42, a first protruding fringe 43, a fillister 44, a second protruding fringe 45 and a second conducting wire 46. A preferred embodiment of a wireless internet apparatus with the plane antenna in accordance with the present invention is included: an even number of radiators 4~41, and a preview arrangement method to connect with the plane and connect with each other on the substance 2. The preferred embodiment of a wireless internet apparatus with the plane antenna in accordance with the present invention is that the plurality of radiators are 14 radiators. The 14 radiators can be divided into two teams. The two teams are arranged symmetrically. There are 7 radiators in a team. The connected angles of the radiators are different. The characters 4~41 represent each of radiators respectively. The first radiator 4 is connecting to the first conductive wire 41 and the second conductive wire 46, and the second conductive wire 46 connects with the second conductive wire 46*b* of the second radiator 4*b*. However, the first conductive wire 41*b* of the second radiator 4*b* connects with the second conductive wire 46*c* of the third radiator 4*c*. The first conductive wire 41 of the third radiator 4*c* connects with the first conductive wire 41*d* of the fourth radiator 4*d*. The second conductive wire 46*d* of the fourth radiator 4*d* connects with the fifth radiator 4*e* of the first conductive wire 41*e*. The second wire 46*e* of the fifth radiator 4*e* connects with the first conductive wire 41*f* of the sixth radiator 4*f*. The radiators in second team arranged symmetrically to the radiators in first team. The first conductive line 41*h* connects with the second export line 52 by the eighth radiator 4*h*; also the second conductive wire 46*h* connects with the second conductive wire 46*i* of the ninth radiator 4*i*. The first conductive wire 41*j* of the tenth radiator 4*j* connects with the first conductive wire 41*k* of the eleventh radiator 4*k*. The second conductive wire 46*l* of the twelfth radiator 41 and the second conductive wire 46*m* of the thirteenth radiator connect with the second wire 46*n* of the fourteenth radiator 4*n*. At least, the first conductive wire 41*n* of the fourteenth radiator 4*n* connects with the first conductive wire 41*g* of the seventh radiator 4*g*.

For manufacturing, the width of the first conductive wire 41, the width of the sharp part 42, the width of the first protruding fringe 43, the width of the fillister 44, the width of the second protruding fringe 45 and the width of second conducting wire 46 are different designs. Therefore, the X-Y flat of the antennas has better radiation pattern and gain benefits to increase the antenna efficiency.

Figure 1:
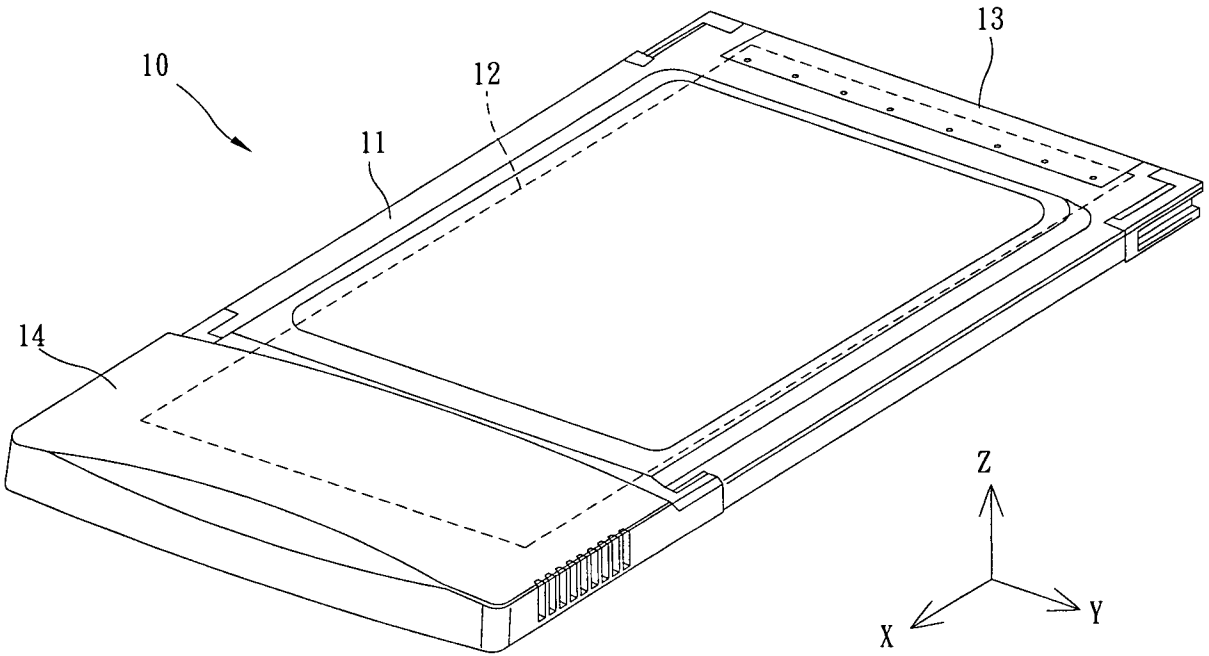
FIG. 1 is a schematic solid view of the design of an antenna.
Figure 2:
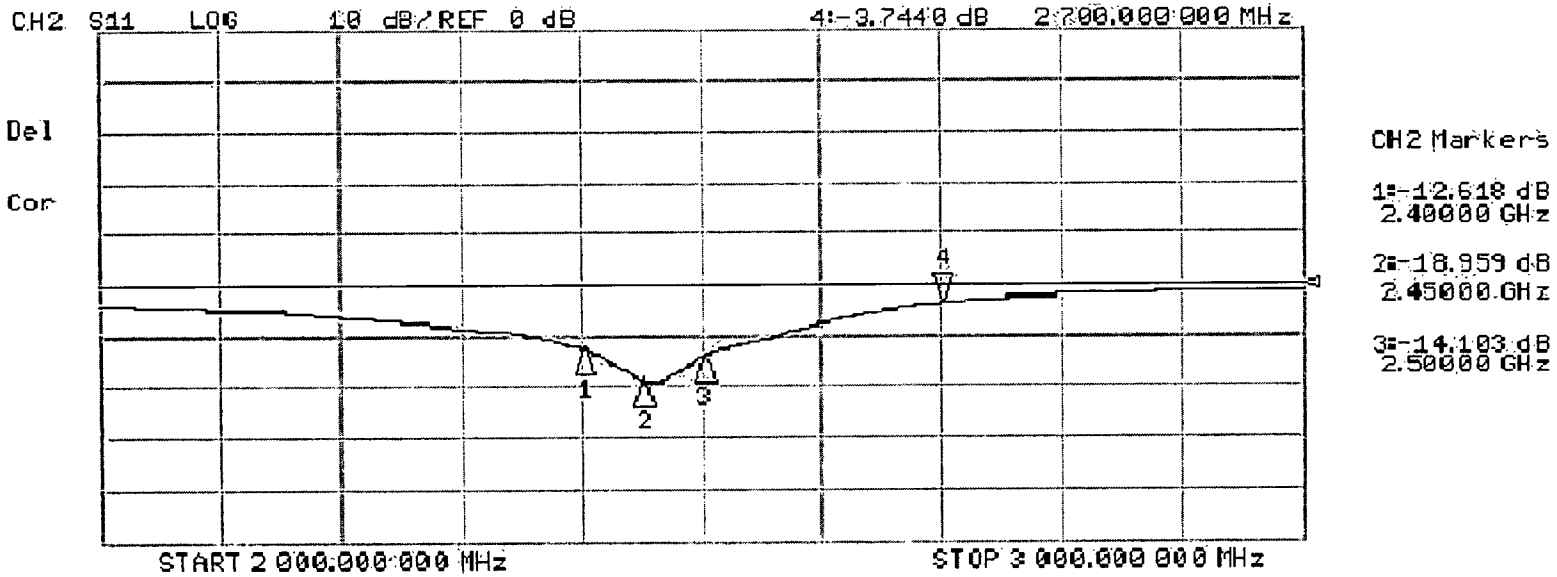
FIG. 2 is shown as the FIG. 1 of the topic wireless network device of the X-Y plane analysis of the radiation pattern.
Figure 3:
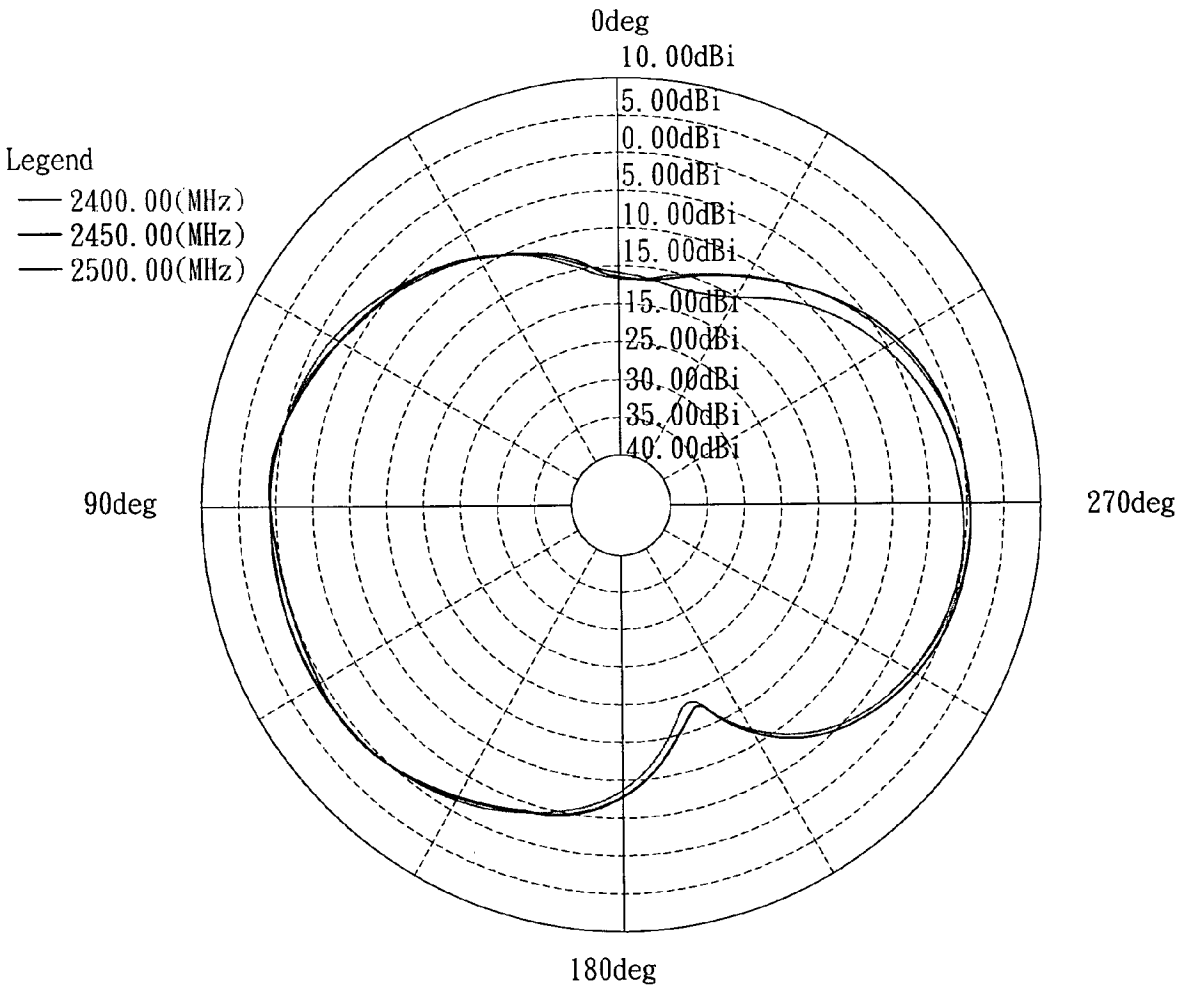
FIG. 3 is shown as the FIG. 1 of the loss of a round trip pattern of the topic wireless network device.
Figure 5:
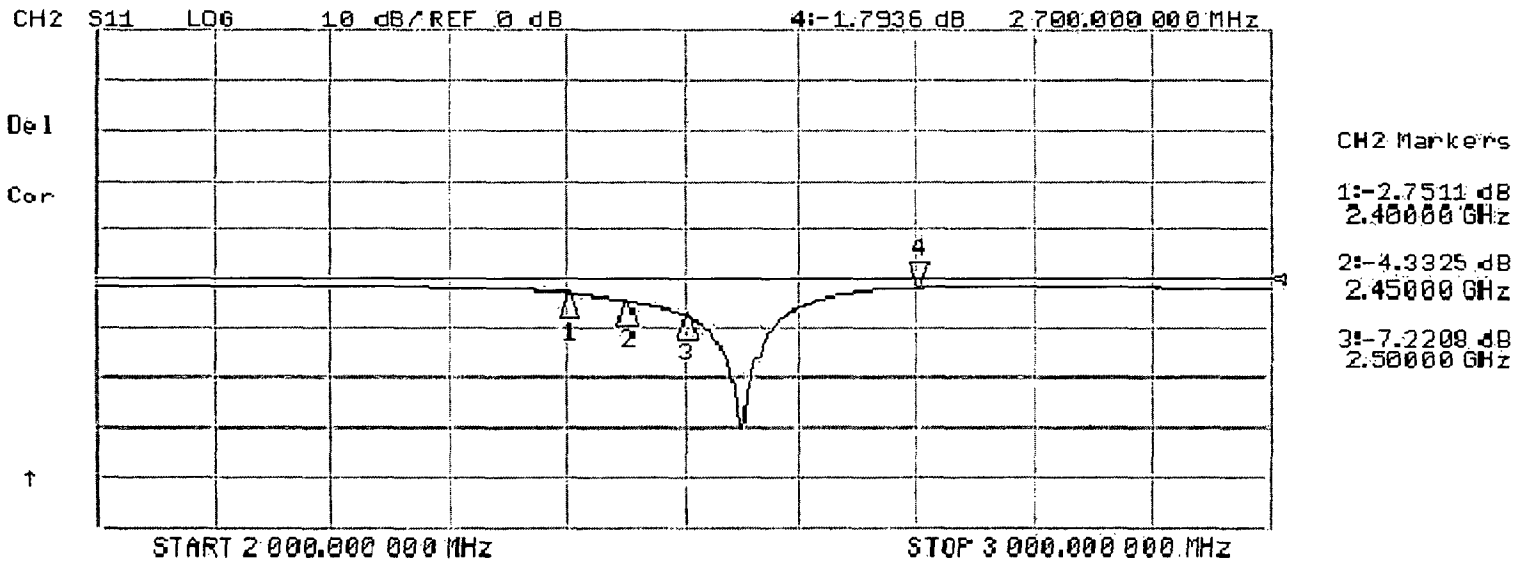
FIG. 5 is shown as the FIG. 4 of the invention of the X-Y plane analysis of the radiation pattern of the plane antenna.
Figure 6:
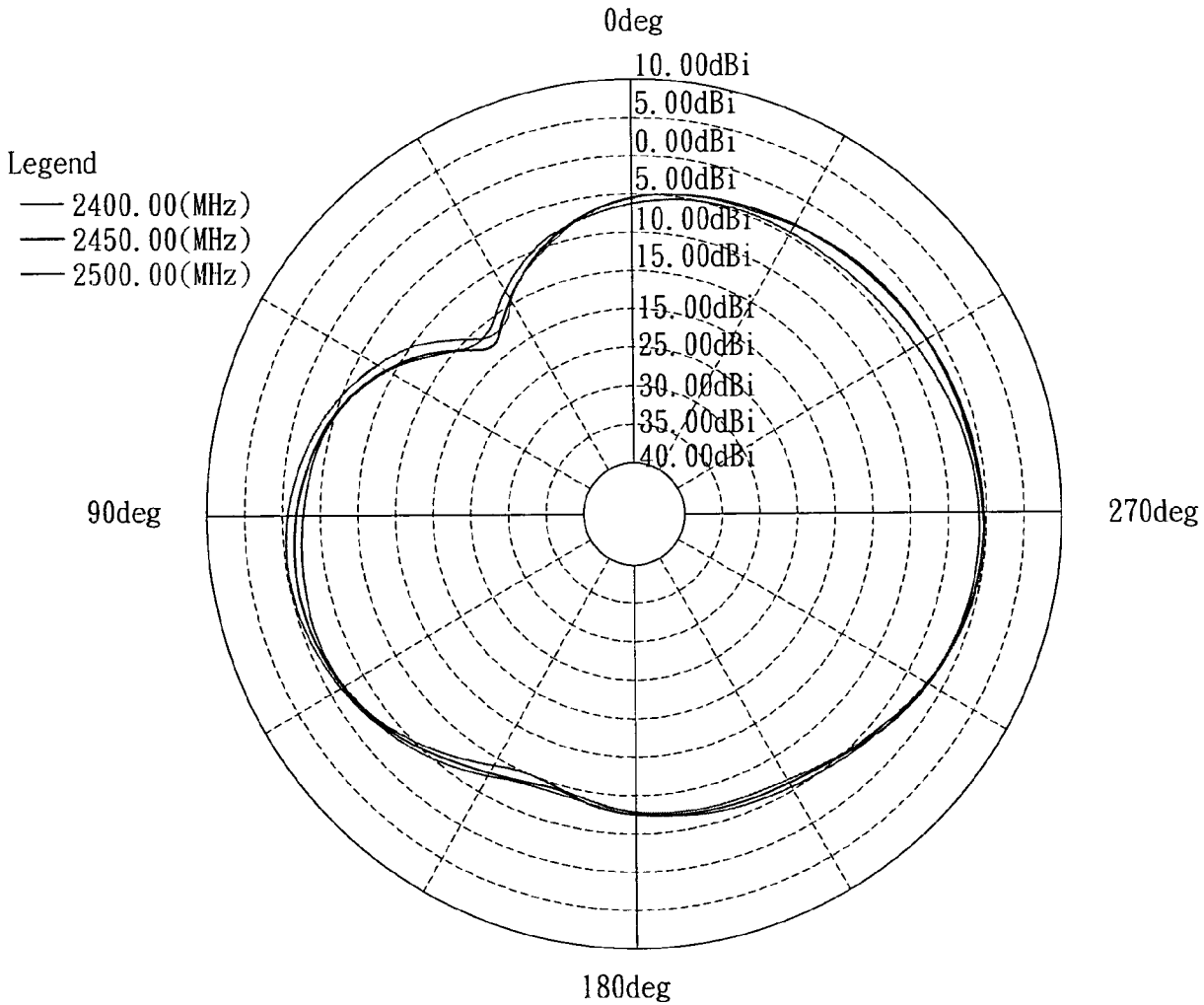
FIG. 6 is shown as the FIG. 4 of the invention of the loss of a round trip of plane antenna pattern.

The radiation pattern of the FIG. 5, the invention of the average gain value is −4.3 dBi plane antenna; the gain efficiency has −8.44 dBi of the FIG. 2 to compare with the prior act. The FIG. 6 of the invention of the plane antenna analyses the loss of a round trip pattern. The frequency range is around 2.4 GHz~2.5 GHz, the invention of the loss of a round trip of the plane antenna is about −2.7 dB; a value is correspond to the high efficiency antenna design of a round trip of the general market is lower than −10 dB request. To be obvious, the invention of the antenna offers the better wireless communication quality and the transmission efficiency.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wireless internet apparatus with a plane antenna, the plane antenna comprising:

a plane;

an import antenna located on the plane, the import antenna having a first import line and a second import line, the second import line and the first import line connected with each other, an included angle formed between the second import line and the first import line;

an export antenna located on the plane, the export antenna having a first export line and a second export line, the second export line and the first export line connected with each other and another included angle formed between the second export line and the first export line, the included angle between the second import line and the first import line being equal to the another included angle between the second export line and the first export line; and a plurality of radiators disposed between the import antenna and the export antenna, each of the radiators having a first conducting wire, a sharp part, a first protruding fringe, a fillister, a second protruding fringe and a second conducting wire, one of the radiators connected to another one of the radiators adjacent to the one of the radiators through the first conducting wire or the second conducting wire, wherein the radiators are divided into two symmetrically arranged teams, connected angles between every two neighboring radiators in one of the teams are different and a width of the first conducting wire, a width of the sharp part, a width of the first protruding fringe, a width of the fillister, a width of the second protruding fringe and a width of the second conducting wire are different.

2. The wireless internet apparatus with a plane antenna of claim 1, wherein the plurality of radiators comprises an even number of radiators.

3. The wireless internet apparatus with a plane antenna of claim 1, wherein the radiators are divided into two teams, and the two teams are arranged symmetrically.

4. The wireless internet apparatus with a plane antenna of claim 2, wherein the even number is 14.

* * * * *